US006415527B1

(12) United States Patent
Räsänen et al.

(10) Patent No.: US 6,415,527 B1
(45) Date of Patent: Jul. 9, 2002

(54) STEAM DRYER

(75) Inventors: Eino Räsänen, Tampere; Olli Tiitu, Parkano, both of (FI)

(73) Assignee: Kumera Corporation, Riihimaki (FI)

( * ) Notice: Subject to any disclaimer, the term of this patent is extended or adjusted under 35 U.S.C. 154(b) by 0 days.

(21) Appl. No.: 09/673,766

(22) PCT Filed: Apr. 15, 1999

(86) PCT No.: PCT/FI99/00310

§ 371 (c)(1),
(2), (4) Date: Oct. 17, 2000

(87) PCT Pub. No.: WO99/54674

PCT Pub. Date: Oct. 28, 1999

(30) Foreign Application Priority Data

Apr. 17, 1998 (FI) ..... 980859

(51) Int. Cl.[7] ..... F26B 11/02
(52) U.S. Cl. ..... 34/135
(58) Field of Search ..... 34/135, 108, 109, 34/126, 127, 134, 140, 141

(56) References Cited

U.S. PATENT DOCUMENTS 4,125,947 A 11/1978 Mamistov et al.
4,260,372 A 4/1981 Keller

FOREIGN PATENT DOCUMENTS

DE 2724639 8/1979
EP 0305706 3/1989
FI 883606 3/1989
FI 962853 1/1998
WO 9802700 2/1998

*Primary Examiner*—Teresa Walberg
*Assistant Examiner*—Vinod D Patel
(74) *Attorney, Agent, or Firm*—Steinberg & Raskin, P.C.

(57) ABSTRACT

The invention concerns a steam dryer, in particular a steam dryer intended for drying of concentrate materials, which dryer comprises a cylindrical, rotatable drum (11), in whose interior a set of steam pipes (12) consisting of a number of pipes has been fitted to revolve along with the drum. The steam intended for drying of the material has been arranged to be supplied into the set of steam pipes (12) by means of steam supply devices fitted at a first end (10A) of the dryer, and at the opposite end (10B) of the steam dryer (10), conveyor (16) has been installed to supply the material to be dried into the drum (11) interior. The dried material (25) has been arranged to be discharged through the first end (10A) of the dryer. The set of steam pipes (12) is composed of a number of pipe elements, each of which is composed of two axial pipes **(12*a*, 12*a*') parallel to the longitudinal direction of the drum (11) and of a number of pipe arcs (12*b*) fitted in the cross direction of the drum (11) and at a distance from one another in the longitudinal direction of the drum, which pipe arcs interconnect the two axial pipes of each pipe element. At the first end (10A) of the steam dryer (10), a steam distributor header (17) has been fitted coaxially with the drum (11)**, through which header the steam meant for drying has been arranged to be fed into each of the pipe elements, and, in a corresponding way, through which header the condensate coming from the pipe elements has been arranged to be removed.

18 Claims, 3 Drawing Sheets

STEAM DRYER

FIELD OF THE INVENTION

The invention concerns a steam dryer, in particular a steam dryer intended for drying of concentrate materials, which dryer comprises a cylindrical, rotatable drum, in whose interior a set of steam pipes consisting of a number of pipes has been fitted to revolve along with the drum, into which set of steam pipes the steam intended for drying of the material has been arranged to be supplied by means of steam supply devices fitted at a first end of the dryer, and in which steam dryer, at the opposite end, a conveyor or equivalent has been installed to supply the material to be dried into the drum interior, from where the dried material has been arranged to be discharged through the first end of the dryer.

BACKGROUND OF THE INVENTION

In the prior art, a number of different types of dryer drums based on the use of steam are known, which drums are used, among other things, for drying of different concentrate materials. In steam dryers of said type, the material to be dried is introduced into the drying drum, and the steam intended for drying is made to flow in pipes fitted inside the drum. Thus, the material to be dried cannot reach direct contact with the steam. Drying drums can be divided into two main types, i.e. into batch-type dryers and, on the other hand, into continuous dryers. In batch-type dryers, of which, as one example, the dryer described in the German Patent No. 27 24 639 can be mentioned, the drying drum is filled to the desired quantity, the supply of steam is started into the set of pipes placed in the interior of the drying drum, and at the same time the drying drum starts revolving. After the material to be dried has been made sufficiently dry, the rotation of the drum is stopped, the supply of steam is switched off, and the drum is emptied. Thus, it can be considered to be a drawback of a batch-type dryer that, exactly owing to its mode of operation, the dryer cannot be used smoothly for drying of large quantities of material.

In continuous dryers, the arrangement is, as a rule, such that the drying drum is rotated constantly, and material to be dried is supplied into the interior of the drum through one end of the drum. During drying, steam is passed constantly into the pipe system provided in the interior of the drum. The drum is provided with purposeful means by which it is rotated during drying, and further, the concentrate material that is fed into the drum during drying is carried towards the opposite end of the drum, out of which end the material is discharged. As a rule, the drum is provided with an adjustable overflow edge or with adjustable discharge openings, and further, it is common that the position of inclination of the drum can be adjusted within certain limits so as to regulate the dwell of the concentrate material in the drum. As an example of such a continuous drying drum, the steam dryer described in the applicant's Patent Application No. 962853 of earlier date can be mentioned.

As regards the construction of prior-art steam drum dryers, it can be stated by way of example that quite commonly such dryers are used in which the steam pipes have been fitted as substantially parallel to the axis of the drum. In such an arrangement, in some cases, it has been noticed to be a problem that an insulating material layer is formed on the faces of the steam pipes out of the material to be dried. In such prior-art dryers in which longitudinal pipes are used, the filling degree of the devices is relatively low, i.e. of an order of 10 . . . 15% of the inside volume of the drum, and such drums are not used commonly in drying of concentrate materials because of their large size and low efficiency.

A further prior-art dryer arrangement is such that in it a separate rotor is employed, which forms the heating face and around which rotor there is a stationary fixed basin placed in a horizontal plane. As a rule, the rotor consists of a number of parallel groups of pipes, which have been arranged along a central tube. Each group of pipes usually comprises a number of concentric pipe rings, and the heat transfer medium that is used can be steam or a liquid. In this prior-art solution, the system of steam pipes, which has been mounted from its ends by means of bearings and which revolves in the concentrate to be dried, imposes a restriction of size, and the size of the equipment cannot be increased economically when the amount of concentrate is increased. A considerable drawback of dryers of this type is rapid wear of the steam pipes, which causes great problems in drying of abrading concentrates, because the rotor revolves in a stationary concentrate bed, in which case the pressure applied by the concentrate to the steam pipes is high and causes intensive wear, as was mentioned above.

OBJECTS AND SUMMARY OF THE INVENTION

The object of the present invention is to provide a steam dryer in particular intended for drying of concentrates, in which dryer abrasion has been eliminated or at least minimized or in which abrasion does not cause problems otherwise, and in which dryer no insulating layer of concentrate can be formed on the steam pipe faces.

Further, it is an object of the solution in accordance with the present invention to provide a steam dryer whose size is not limited, but which can be constructed in each case suitable for the purpose in compliance with the desired production quantity.

Further, it is an object of the present invention to provide a steam dryer in which it is possible to utilize steam that is produced elsewhere in the process of treatment of the concentrates. In view of achieving the objectives of the invention, the present invention is mainly characterized in that the set of steam pipes is composed of a number of pipe elements, each of which comprises two axial pipes parallel to the longitudinal direction of the drum and a number of pipe arcs fitted in the cross direction of the drum and at a distance from one another in relation to the longitudinal direction of the drum, which pipe arcs interconnect the two axial pipes of each pipe element, and that, at the first end of the steam dryer, a steam distributor header has been fitted coaxially with the drum, through which header the steam meant for drying has been arranged to be fed into each pipe element, and through which steam inlet header, in a corresponding way, the removal of the condensate coming from the pipe elements has been arranged.

In the arrangement of equipment in accordance with the invention, the set of steam pipes in the dryer revolves along with the drum, in which case no pressure and no abrading difference in speed is formed between the material to be dried and the steam pipes, and further, longitudinal raising blades fitted on the inside face of the drum eliminate excessive gliding of the material on the face of the drum, in which case abrasion of the steam pipes or formation of a material layer on the faces of the steam pipes do not cause problems, nor is the size of the construction restricted by the bearing system of the steam pipes or by any other, similar factor. In a steam dryer in accordance with the invention, the concentrate to be dried is supplied into the drum through one end of the drum by means of a suitable conveyor, and the concentrate is discharged out of the drum through discharge openings provided at the opposite end of the drum. The dryer is provided with adjustable discharge openings, through which the dried material is discharged and by means of which discharge openings an adequate dwell of the material in the dryer and, at the same time, a suitable filling degree are secured.

The drum of the dryer and the set of pipes placed inside the drum are rotated during drying, and therefore the drum is provided with a purposeful mechanism of rotation, for example, similar to that described earlier in the applicant's Finnish Patent Application No. 962853. Also, a mechanism of rotation of a different sort suitable for the purpose can be used.

The set of pipes placed in the drum has been formed and composed of elements, which can be removed from the drum and replaced separately, whereas, in the prior art, in the applicant's earlier Finnish Patent Application No. 962853, the set of steam pipes consisted of one large and heavy part. In this novel dryer, the service life and the usability of the dryer can be improved, because, if necessary, the tube elements can be replaced quickly and easily, which reduces the standstill time of the dryer.

By means of the steam dryer in accordance with the invention, high drying efficiency is obtained, because the filling degree of the drum can be made very high and the drum is filled with steam pipes. In a dryer in accordance with the invention, a filling degree of even higher than 30 per cent can be achieved.

The drum of the steam dryer in accordance with the invention can also be in an inclined position so as to enhance the transfer of the material to be dried and to remove the condensate.

BRIEF DESCRIPTION OF THE DRAWINGS

The further advantages and characteristic features of the invention will come out in more detail in the following detailed description of the invention, in which the invention is described with reference to the figures in the accompanying drawing.

DETAILED DESCRIPTION OF THE PREFERRED EMBODIMENTS

Figure 1:
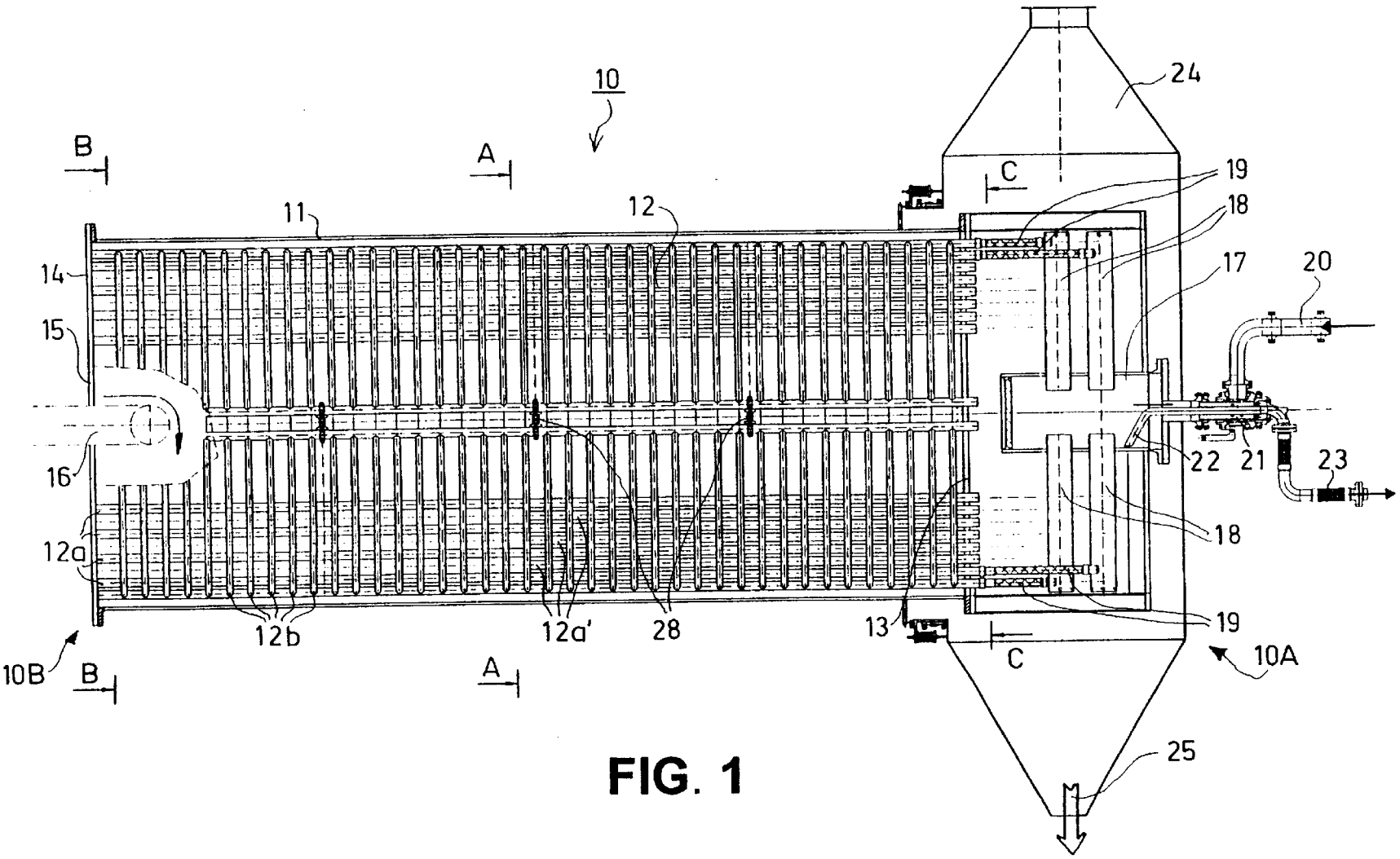
FIG. 1 is a schematic longitudinal sectional view of a steam dryer in accordance with the invention.

In FIG. 1 the steam dryer is denoted generally with the reference numeral 10. The steam dryer 10 comprises a drying drum 11, in whose interior a set of steam pipes 12 has been fitted. The steam is fed into the set of steam pipes 12 placed in the interior of the drum 11, and similarly the steam is passed out of the drum, through a first end 10A of the dryer, and, on the other hand, the material to be dried, which is in particular a concentrate, is passed into the interior of the drum through the second end 10B of the drum. During drying, the material passes in the axial direction through the drum 11 and is discharged through the first end 10A of the dryer. The material to be dried is introduced into the drum 11 by means of a conveyor 16, which is, for example, a belt conveyor similar to that illustrated in FIG. 1. A conveyor of a different type can also be used. For the supply of the material into the drum, an opening 15 has been formed into the end 14 at the second end 10B of the drum 11, through which opening 15 the conveyor 16 extends into the interior of the drum. The steam is passed into the set of steam pipes 12 placed inside the drum 11 through a feed pipe 20 fitted at the first end 10A of the dryer and through a revolving steam coupling 21. At the first end 10A of the dryer, a steam distributor header 17 coaxial with the drum 11 has been arranged, into which header the steam enters out of the feed pipe 20. The steam header 17 has been fitted in the axial direction outside the end 13 of the first end 10A of the drum 11. The steam header 17 revolves along with the drum 11. The steam 17 header is provided with radial connector pipes 18, whose inner ends open into the interior of the steam header 17 and whose outer ends are closed. The radial connector pipes 18 communicate with the set of steam pipes 12 in the interior of the drum 11 through flexible hoses 19.

Figure 2:
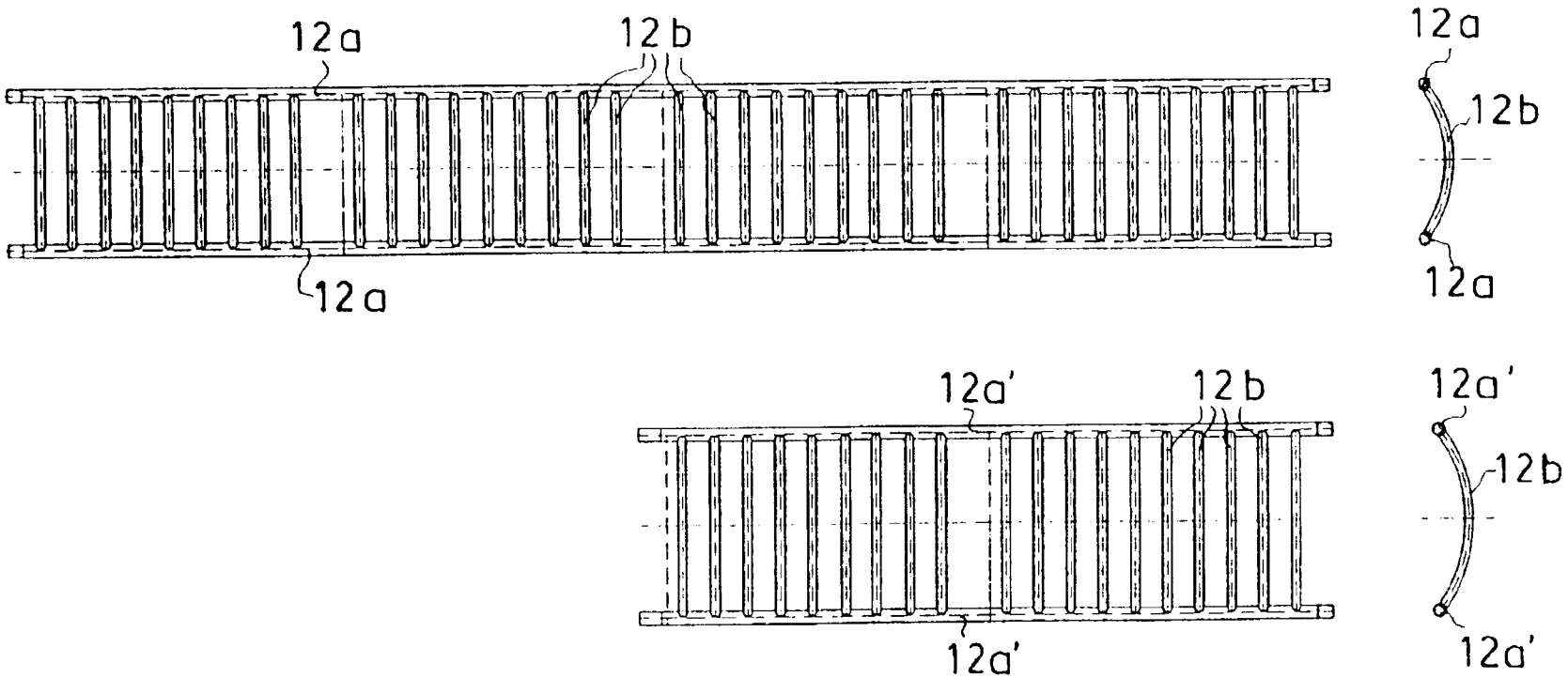
FIG. 2 is a schematic illustration of the pipe elements placed in the interior of the drum of the steam dryer.
Figure 3C:
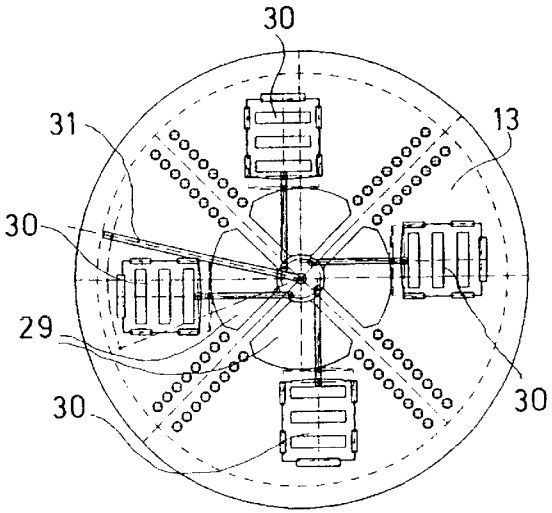
FIGS. 3A, 3B and 3C are schematic cross-directional sectional views of a steam dryer in accordance with the invention taken along lines A—A, B—B and C—C of FIG. 1.
Figure 3B:
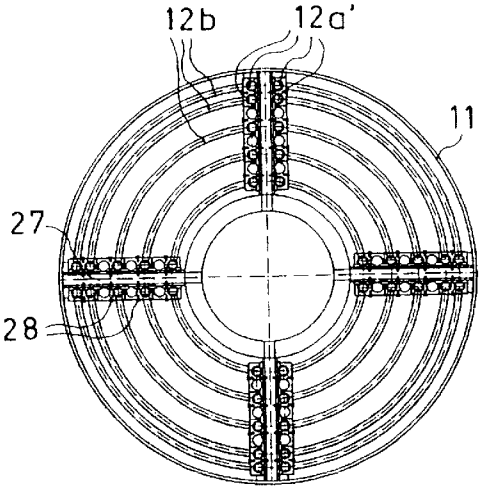
Figure 3A:
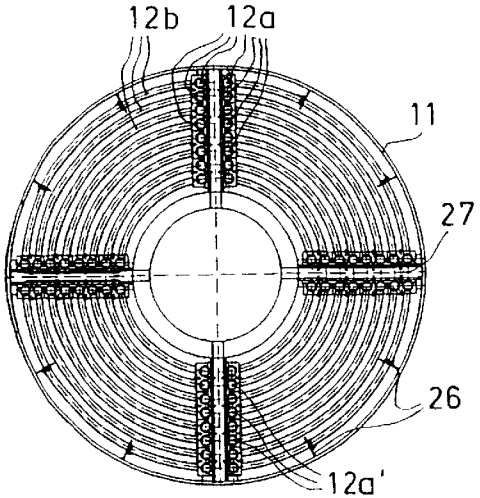

The set of steam pipes 12 placed inside the drum 11 consists of axial pipes 12*a*, 12*a*' fitted in the drum and of pipe arcs 12*b* which interconnect said pipes. As is shown in FIGS. 1 and 2, the axial pipes can extend as axial pipes 12*a* of a length equal to the length of the whole drum 11 extending between the ends 13,14 of the drum, or the axial pipes 12*a*' may extend just over a part of the axial length of the drum from the end 13 of the first end 10A. Besides in FIGS. 1 and 2, this is also illustrated in FIGS. 3A and 3B, of which FIG. 3A is a sectional view taken along the line A—A in FIG. 1, and, similarly, FIG. 3B is a sectional view taken along the line B—B in FIG. 1. A number of axial pipes 12*a* and 12*a*' have been fitted on a radius of the drum 10, and, in each particular case, a number of pipe arcs 12*b* have been arranged to interconnect two axial pipes, which arcs are placed at a distance from one another in the axial direction of the drum 11, as is shown by FIG. 1. Two axial pipes 12*a* or 12*a*', respectively, and the connecting pipe arcs 12*b* always form a pipe element, which can be removed separately from the interior of the drum 10. In the interior of the drum, support constructions 27 have been attached, to which support constructions each pipe element has been attached, for example, by means of screw joints 28 shown in FIGS. 1 and 3B or by means of corresponding joints, which permit movement arising from thermal expansion of the pipe elements.

In the arrangement in accordance with the present invention, through-flow of steam in the set of steam pipes 12 has not been employed, but the set of steam pipes 12 forms a closed space for the steam. This has been arranged so that one end of the axial pipes 12*a* and 12*a*' has been closed. As was already described above, the axial pipes extend a certain distance through the end 13 of the first end of the dryer, where they communicate with radial connector pipes 18 through flexible hoses, for example steel hoses. In such a case, when steam is fed out of the feed pipe 20 into the steam distributor header 17, the steam is carried from the header through the radial connector pipes 18 and through the flexible hoses 19 into the axial pipes 12*a* and 12*a*' and into the pipe arcs 12*b* which interconnect said axial pipes. When the steam condenses, the condensate water flows along the same route back into the steam distributor header 17, from which it is drained away by means of a syphon pipe 22 into a condensate discharge pipe 23. The removal of condensate can be enhanced by inclining the steam dryer. The exhaust gases from drying are passed away from the dryer along a gas duct 24 into a filter (not shown).

The dried concentrate is passed out of the steam dryer 10 through the first end 10A of the dryer. For this purpose, at the end 13 of the drum 11, in the way shown in FIG. 3C, overflow openings 29 have been formed, and further, in said end 13, adjustable discharge openings 30 have been fitted, and the opening degree of the discharge openings 30 can be regulated by means of a regulation mechanism 31. When the drum 11 and the set of steam pipes 12 revolve, the concentrate to be dried passes through the drum 11, and, as the raising blades 26 shown in FIG. 3A prevent gliding of the material on the inner face of the drum 11, the material is discharged through the discharge openings 30, in which connection, as a result, a dried concentrate is obtained, which is denoted with an arrow and with the reference numeral 25.

In the figures in the drawing, the mechanism of rotation of the drum or the mechanism of inclination of the drum are not shown, but, as was already stated above, as the mechanism of rotation and as the mechanism of inclination, it is possible to use, for example, the arrangement described in the applicant's Finnish Patent Application No. 962853 of earlier date. In such a case, by means of the angle of inclination of the drum 11, the adjustable speed of rotation, and the adjustable discharge openings 30, the dwell of the concentrate in the steam dryer 10 can be regulated.

Above, the invention has been described by way of example with reference to the exemplifying embodiment illustrated in the figures in the accompanying drawing. The invention is, however, not confined to the exemplifying embodiment shown in the figures alone, but different embodiments of the invention may show variation within the scope of the inventive idea defined in the accompanying patent claims.

What is claimed is:

1. A steam dryer, in particular a steam dryer intended for drying of concentrate materials, which dryer comprises a cylindrical, rotatable drum (11), in whose interior a set of steam pipes (12) having a number of pipe elements has been fitted to revolve along with the drum, which pipe elements can be separately detached from the drum (11) and separately installed into the drum, into which set of steam pipes (12) the steam intended for drying of the material has been arranged to be supplied by means of a steam distributor header (17) fitted at a first end (10A) of the dryer coaxially with the drum (11), and in which steam dryer (10), at an opposite end (10B), a conveyor (16) has been installed to supply the material to be dried into the drum (11) interior, from where the dried material (25) has been arranged to be discharged through the first end (10A) of the dryer, characterized in that each of the pipe elements in the set of steam pipes (12) is composed of two axial pipes (12*a*, 12*a*') parallel to a longitudinal direction of the drum (11) and of a number of pipe arcs (12*b*) fitted in a cross direction of the drum (11) and at a distance from one another in the longitudinal direction of the drum, which pipe arcs interconnect the two axial pipes of each pipe element, and the axial pipes (12*a*, 12*a*') of each pipe element have been connected to the steam header (17) so as to feed steam meant for drying into the pipe elements, and, in a corresponding way, to remove a condensate from the pipe elements through the steam header (17).

2. A steam dryer as claimed in claim 1, wherein the pipe elements have been fitted in the interior of the drum (11) so that, in each element, the axial pipes (12*a*, 12*a*') are placed substantially at the same distance from a longitudinal center line of the drum (11).

3. A steam dryer as claimed in claim 1, wherein, in the interior of the drum (11), a number of pipe elements composed of two axial pipes (12*a*, 12*a*') and a number of cross-direction pipe arcs (12*b*) have been fitted one inside the other in the direction of a radius of the drum (11) at a distance from one another so that the pipe arcs (12*b*) of adjacent pipe elements which are placed substantially at the same distance from the longitudinal center line of the drum (11) form a continuous ring parallel to the circumference of the drum (11).

4. A steam dryer as claimed in claim 1, wherein the supply of drying steam from the steam distributor header (17) into the pipe elements placed inside the drum (11) has been arranged to take place through radial connector pipes (18) fitted in the steam distributor header (17) and through flexible hoses (19), which connect the connector pipes with the pipe elements.

5. A steam dryer as claimed in claim 1, wherein the axial pipes (12*a*, 12*a*') of the pipe elements are fully closed at their end opposite to the steam supply end, so that through-flow of steam in the pipe elements is prevented.

6. A steam dryer as claimed in claim 5, wherein condensate water has been arranged to be drained out of the pipe elements into the steam distributor header (17) along the same route along which it has been fed into the pipe elements, and that a syphon pipe (22) has been fitted in the steam header, through which syphon the condensate water has been arranged to be sucked out of the steam header.

7. A steam dryer as in claim 1, wherein at least a part of the pipe elements have been formed as extending across the entire axial length of the drum (11).

8. A steam dryer as claimed in claim 1, wherein a part of the pipe elements have been formed as extending across the entire axial length of the drum (11).

9. A steam dryer as claimed in claim 1, wherein into the interior of the drum (11), support constructions (27) have been installed for the pipe elements, to which support constructions the pipe elements have been attached by means of a fastening that permits thermal expansion.

10. A steam dryer for the drying of concentrate materials, comprising:

a cylindrical rotatable drum having a first end and a second end, said first end structured and arranged to receive concentrate material into said drum and said second end structured and arranged to discharge concentrate material from said drum;

a set of steam pipes having a plurality of elements structured and arranged to be inserted within said drum and being rotatable therewith, said steam pipes comprising at least two axial pipes being parallel to a longitudinal direction of said drum and interconnected by a plurality of longitudinally spaced transverse pipe arcs substantially conforming to the cross sectional shape of said drum;

a steam distributor header structured and arranged at said first end of said drum and being coaxial therewith, said stream distributor being structured and arranged to supply said set of steam pipes with steam intended for drying of said concentrate material as said concentrate material passes through said drum and for removing a condensate formed in said steam pipes; and conveyance means disposed at said second end of said drum and structured and arranged for supplying said concentrate material into said steam dryer for drying.

11. The steam dryer according to claim 10, wherein said pipe elements are structured and arranged within the interior of said drum such that said axial pipes of each pipe element is placed substantially equidistant from a longitudinal center line of said drum.

12. The steam dryer according to claim 10, further comprising:

a plurality of pipe elements within the interior of said drum, said plurality of pipe elements composed of two axial pipes interconnected by a plurality of cross-direction pipe arcs having been fitted one inside the other in a radial direction of said drum at a distance from one another so that the pipe arcs of an adjacent set of pipe elements which are also placed substantially at the same distance from the longitudinal center line of said drum, form a continuous ring parallel to the circumference of the drum.

13. The steam dryer according to claim 10, wherein said supply ofdrying steam from said steam distributor header into said pipe elements placed within said drum is structured and arranged to take place through a plurality of radial connector pipes fitted within said steam distributor header and through a plurality of flexible hoses interconnecting each one of a plurality of said connector pipes to a corresponding one of a plurality of said pipe elements.

14. The steam dryer according to claim 10, wherein said axial pipes of said pipe elements are fully closed at an end opposite said steam supply end, whereby through-flow of steam through said pipe elements is prevented.

15. The steam dryer according to claim 14, wherein condensate water has been arranged to be drained out of said pipe elements into said steam distributor header via the same route along which said steam has been fed into said pipe elements, and wherein a syphon pipe is structured and arranged within said steam header such that said condensate water is withdrawn from steam header.

16. The steam dryer according to claim 10, wherein at least a part of said pipe elements have been formed as extending across the entire axial length of said drum.

17. The steam dryer according to claim 10, wherein a part of said pipe elements have been formed as extending across the entire axial length of said drum.

18. The steam dryer according to claim 10, further comprising:

a plurality of support constructions structured and arranged within said interior of said drum for supporting said pipe elements, said pipe elements being attached to said support constructions by fastening means permitting thermal expansion.

* * * * *